United States Patent [19]

Bremmer et al.

[11] Patent Number: 4,869,219

[45] Date of Patent: Sep. 26, 1989

[54] DUAL SPRING AIR FUEL CONTROL FOR THE PT FUEL SYSTEM

[75] Inventors: Robin J. Bremmer; Roscoe A. Baker, both of Columbus, Ind.

[73] Assignee: Cummins Engine Company, Inc., Columbus, Ind.

[21] Appl. No.: 220,939

[22] Filed: Jun. 23, 1988

Related U.S. Application Data

[63] Continuation of Ser. No. 885,200, Jul. 14, 1986, abandoned.

[51] Int. Cl.[4] ..... F02M 31/00

[52] U.S. Cl. ..... 123/383; 123/452; 123/46

[58] Field of Search ..... 123/514, 463, 382, 383, 123/452, 385, 386, 387

[56] References Cited

U.S. PATENT DOCUMENTS

| | | | |
|---|---|---|---|
| 3,795,233 | 3/1974 | Crews et al. | 123/383 |
| 3,818,883 | 6/1974 | Glassey | 123/382 |
| 4,095,572 | 6/1978 | Scholtz | 123/383 |
| 4,149,507 | 4/1979 | Little | 123/383 |
| 4,176,641 | 12/1979 | Perr | 123/383 |
| 4,187,817 | 2/1980 | Wilson et al. | 123/383 |
| 4,248,188 | 2/1981 | Wilson et al. | 123/383 |
| 4,384,560 | 5/1983 | Jäger | 123/383 |
| 4,508,080 | 4/1985 | Nakamura | 123/383 |

FOREIGN PATENT DOCUMENTS

| | | | |
|---|---|---|---|
| 47-20662 | 12/1972 | Japan | 123/463 |

*Primary Examiner*—Carl Stuart Miller

*Attorney, Agent, or Firm*—Sixbey, Friedman, Leedom & Ferguson

[57] ABSTRACT

A tamper-proof dual spring controlled air fuel control for a compression ignition type internal combustion engine is provided wherein fuel is supplied to the engine cylinders in response to the pressure of the air in the intake manifold. A pair of oppositely biased springs controls the movement of a stem valve in response to intake manifold air pressure exerted on a flexible diaphragm located between the oppositely biased springs. The stem valve includes a plunger within a barrel in the air fuel control housing in the engine fuel pump. The cross-sectional profiles of the plunger and barrel are designed to meter precisely a controlled amount of fuel to the engine fuel supply system as the intake air pressure increases and to reduce this metered flow as the intake air pressure decreases. Two plunger and barrel assembly embodiments having different profiles are provided. A class fit between the barrel and plunger of the present air fuel control wherein the clearance must not exceed 0.000075 to 0.000125 inches and pressure regulating means located in the plunger substantially eliminate fuel leakage from the barrel. Internal venting means are provided to direct any minimal amount of fuel which might leak to the engine crankcase.

25 Claims, 3 Drawing Sheets

DUAL SPRING AIR FUEL CONTROL FOR THE PT FUEL SYSTEM

This application is a continuation of application Ser. No. 885,200, filed July 14, 1986, now abandoned.

The present invention relates generally to air fuel control systems for internal combustion engines and specifically to a dual spring air fuel control for a compression ignition type internal combustion engine wherein fuel is supplied to the engine cylinders in response to intake manifold air pressure.

BACKGROUND ART

Regulation of the air and fuel mixture supplied to an internal combustion engine, particularly an engine of the compression ignition type, has received widespread attention. Unless a satisfactory air/fuel ratio is achieved in the engine cylinders, engine operation will be adversely affected and fuel economy will be reduced. Proper regulation of the air/fuel mixture, moreover, can eliminate or reduce substantially undesirable emission components from the engine exhaust. If air and fuel are supplied to the cylinders in a carefully controlled ratio which will allow complete combustion to occur under all operating conditions, apparatus for removing exhaust emissions to achieve acceptable vehicle emission control can be entirely eliminated. In addition, efficient and economic engine operation will be realized as well.

Fuel systems for internal combustion engines wherein the fuel supplied to the engine is controlled in response to intake manifold pressure are well known. Many such systems include a source of fuel under pressure, e.g., a fuel pump, and a mechanism for regulating the pressure of the fuel supplied to an injector located at each cylinder. To achieve optimum fuel/air ratios under all operating conditions, highly sophisticated refinements have been made in these basic components to permit a carefully scheduled pressure output as a function of operator demand and engine speed. U.S. Pat. Nos. 4,187,817 to Wilson et al. and 4,248,188 to Wilson et al. are illustrative of such systems. The air/fuel control systems described in these patents mechanically modulate the flow of fuel into the engine in response to the pressure of the air in the intake manifold, which varies from a "no-air" condition below the rated pressure level to the full rated pressure. Both systems employ a diaphragm or flexible bellows operator for a fuel flow modulating valve responsive to engine intake manifold air pressure as sensed through an air line connecting the diaphragm operator with the intake manifold. The diaphragm is biased by a single spring selected and calibrated to provide modulation of the valve restriction to vary the fuel pressure in response to intake manifold pressure whereby the optimum air/fuel ratio can be maintained over a broad range of operating conditions. A drain line is additionally included in these systems to provide a fluid connection between the air fuel control mechanism and the engine fuel tank.

The air fuel control system disclosed in U.S. Pat. No. 4,187,817 further includes a flow restrictor in the air line to prevent engine fuel tank pressurization and reverse fuel flow into the engine's intake manifold in the event of a rupture of the diaphragm operator. The air fuel control system of U.S. Pat. No. 4,248,188 includes, in addition, an attenuator assembly which attenuates the transient response of the diaphragm operator by causing fuel to be supplied to a control chamber at a rate which is greater than that at which fuel is discharged from the chamber. While these air fuel control systems generally achieve an adequate air/fuel ratio, very precisely controlled metering of fuel is difficult to achieve and, hence, an optimum air/fuel ratio is not always realized for all engine operating conditions. Moreover, the variations in back pressure which have been characteristic of these prior art air fuel controls have caused air fuel control delay variations and, consequently, response problems. Further, engines intended for marine applications have not been able to em ploy the kind of drain line disclosed by the prior art air fuel controls. In the event of a diaphragm failure in a prior art air fuel control of the kind described in the aforementioned patents in a marine engine, fuel would tend to collect in the bilge.

Other air fuel control systems which employ diaphragm operators are also known in the prior art. For example, U.S. Pat. No. 3,795,233 to Crews et al. discloses a control device for a super-charged engine having a governor means connected to a fuel-adjusting member and a supercharger which supplies air to the engine through an intake manifold. Three spring members are employed in this system to balance forces on the diaphragm when there is no pressure in the control system chamber on the intake manifold side of the diaphragm. This system is responsive to both intake air pressure and engine oil pressure to override the governor means. However, the system described in this patent does not include a fuel flow modulating valve, but employs a mechanical linkage to vary the fuel supplied to the engine upstream of the throttle.

None of the air fuel control devices disclosed by the prior art, moreover, is completely tamper-resistant. Improper tampering with an internal combustion engine fuel supply adversely affects both fuel economy and long term engine durability. Fuel systems of the type described in the aforementioned patents generally include a drain line to the fuel tank for returning fuel which is not injected into the engine cylinders or which is bled from the gear pump section of the fuel pump and an adjustable air screw in the fuel pump. It is widely known that the short terms power output of engines equipped with such fuel system can be increased by clamping off this drain line and opening the air screw. However, the effects of such unauthorized modification can be extremely adverse, including loss of fuel economy and shortened engine life. In addition, such unauthorized adjustments will cause engine emissions to vary from those achieved by the air fuel control settings set by the engine manufacturer so that the engine does not comply with governmentally established emissions standards.

The prior art, therefore, fails to disclose an air fuel control for an internal combustion engine which responds quickly to meter a controlled, optimum amount of fuel in response to intake manifold air pressure and which cannot be adjusted or otherwise modified while the air fuel control remains mounted on the engine.

SUMMARY OF THE INVENTION

It is a primary object of the present invention, therefore, to overcome the disadvantages of the prior art.

It is another object of the present invention to provide an air fuel control for an internal combustion engine which responds quickly to meter a controlled amount of fuel in response to changing intake manifold air pressure.

It is a further object of the present invention to provide an air fuel control for an internal combustion engine including a diaphragm operator for a fuel flow modulating valve having a pair of oppositely biased springs located on opposite sides of the diaphragm operator which control the position of the valve in response to intake manifold air pressure.

It is a still further object of the present invention to provide an air fuel control including a diaphragm-operated fuel flow modulating valve including a valve plunger having a profile which is received within a barrel mounted in the air fuel control housing in a manner which assures a class fit between the plunger and the barrel to minimize fuel leakage.

It is another object of the present invention to provide a barrel and plunger assembly for an air fuel control which includes internal pressure differential controlling means for substantially eliminating fuel leakage from the barrel and plunger assembly.

It is yet another object of the present invention to provide an air fuel control system for an internal combustion engine which cannot be adjusted on the engine, but must be removed from the engine before adjustment can be made.

It is still another object of the present invention to provide an air fuel control system for an internal combustion engine which internally vents excess fuel into the engine crankcase and, therefore, does not require a drain line connecting the air fuel control system and the engine fuel tank.

It is still another object of the present invention to provide a repair kit for retrofitting previously existing engines operationally controlled by the pressure of fuel supplied thereto and equipped with an air fuel control mechanism having a diaphragm-operated fuel flow modulating valve of the plunger and barrel type to provide more precise control of fuel metering and to eliminate substantially leakage of excess fuel from the air fuel control.

In accordance with the aforesaid objects, an air fuel control system for an internal combustion engine which is operationally controlled by the pressure of fuel supplied to the engine from a fuel source and which has an intake manifold for supplying air to the engine is provided comprising air pressure responsive means for modulating mechanically the flow of fuel into the engine in response to the pressure of air within the intake manifold including a cavity, pressure-responsive actuating means within the cavity, and an air line connecting the cavity with the intake manifold. The pressure-responsive actuating means transforms changes in intake manifold pressure into mechanical movement to operate the pressure-responsive actuating means. The pressure-responsive actuating means includes first and second chambers, separated by the diaphragm attached to a piston, and the first chamber is connected to the intake manifold by the air line. A first main spring biases the piston toward the first chamber, and a second bias spring biases the piston away from the first chamber. The pressure-responsive actuating means further includes fuel metering means for controlling the flow of fuel into the air-fuel control in response to intake manifold air pressure. The fuel metering means includes a barrel and plunger assembly specifically configured to accommodate both the no-air and transition-curve fuel rail pressures. The barrel and plunger profiles are designed to meter fuel quickly and precisely in response to changes in manifold air pressure and, in addition, are fitted together with a class fit to minimize the leakage of excess fuel. Internal pressure differential controlling means are additionally provided within the plunger to eliminate substantially fuel leakage. Two alternate barrel and plunger assembly embodiments with different cross-sectional profiles are also provided. Internal vent means are additionally provided to direct any excess fuel from the air fuel control into the engine crankcase.

Still other and more specific objects of this invention can be appreciated by consideration of the following Brief Description of the Drawings and the following description of the Best Mode for Carrying Out the Invention.

BEST MODE FOR CARRYING OUT THE INVENTION

The type of fuel system in which the subject invention is likely to be employed will be found in an internal combustion engine of the compression ignition type wherein the engine is controlled by the pressure of the fuel supplied thereto by the fuel supply system. This type of engine includes a plurality of cylinders into which fuel is injected by fuel injectors which are synchronously actuated with the movement of the engine pistons. The quantity of fuel actually injected into each cylinder depends upon the pressure of the fuel supplied to a common rail or line by the fuel supply system. The pressure of this fuel, in turn, is determined by a scheduled pressure output as a function of operator demand, generally indicated by the throttle position, and as a function of engine speed. The kind of fuel supply system for which the present invention is ideally suited is described in U.S. Pat. Nos. 4,187,817 and 4,248,188, assigned to the same assignee as the present invention, and the disclosure of these patents is hereby incorporated by reference.

The achievement of an optimum and accurate air fuel ratio within each engine cylinder is particularly important in turbocharged engines where the intake pressure may fall below the rated pressure under certain operating conditions. Consequently, the capability for mechanically modulating and controlling the flow of fuel into the engine in response to the pressure of the air in the intake manifold is essential to efficient engine operation. Moreover, it is also essential to the achievement of efficient engine operation and acceptable exhaust emission levels to maintain the air/fuel ratio within a predetermined operating range which cannot be adjusted while the air fuel control is mounted on the engine, but requires removal of the air fuel control from the engine prior to adjustment.

Figure 1:
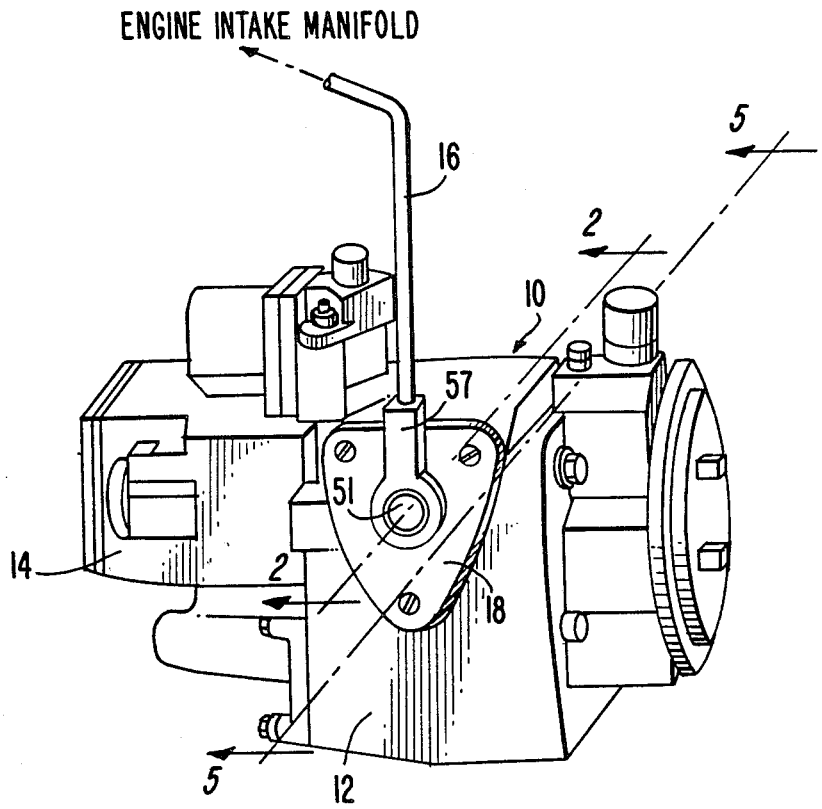
FIG. 1 is a perspective view of a portion of an engine fuel supply system illustrating an air fuel control for modulating fuel flow to the engine in response to the air pressure within the intake manifold of the engine.

Referring to the drawings, FIG. 1 illustrates an air fuel control 10 which may be effectively employed to achieve and maintain a proper supply of fuel to the cylinders in response to intake manifold pressure. Related portions of the engine fuel supply system are additionally illustrated in FIG. 1. These include the fuel pump 12 and the gear pump 14. An air line 16 provides a direct connection between the engine intake manifold (not shown) and the air fuel control interior through cover plate 18.

Figure 2:
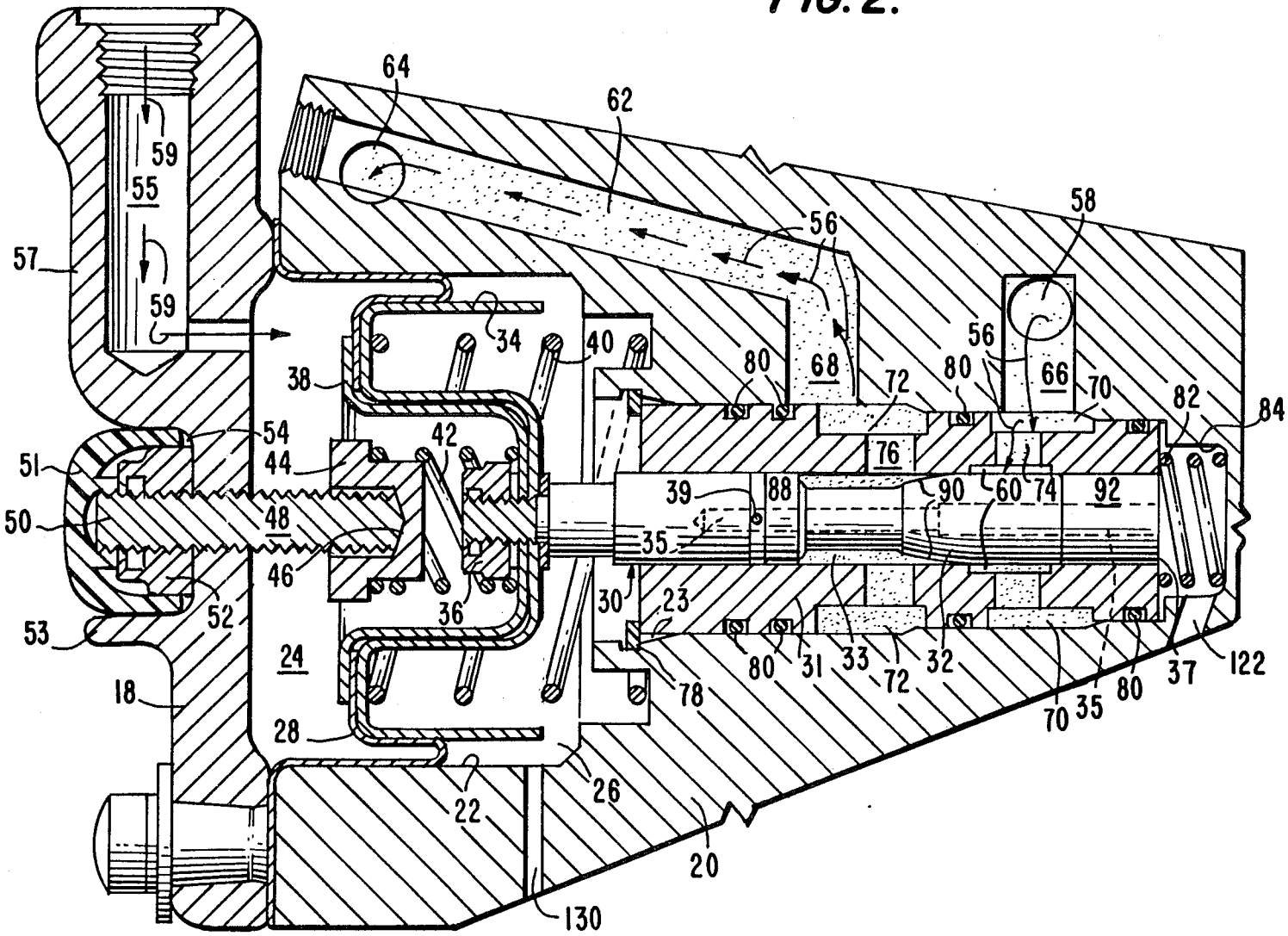
FIG. 2 is a cross-sectional view of the air fuel control illustrated in FIG. 1 taken along lines 2—2 wherein the cover has been rotated 90° in a counter-clockwise direction.

In order to understand fully the subject invention, it is necessary to describe the operation of the air fuel control 10 and the manner by which it operates to modulate the flow of fuel to an internal combustion engine in response to the pressure within the intake manifold of the engine. Reference is made to FIG. 2 for this purpose. FIG. 2 illustrates a cross-sectional view of the air fuel control 10 taken along line 2—2 of FIG. 1 wherein the cover 18 has been rotated 90° in a counterclockwise direction for purposes of discussion. FIG. 2 illustrates the condition of the air fuel control when the pressure within the intake manifold is below the rated pressure level. A "no-air" condition results when the intake manifold pressure is zero or when the air supply line to the air fuel control is disconnected.

The air fuel control 10 includes a housing 20 containing a control chamber 22 subdivided into a first chamber 24 and a second chamber 26 by a flexible bellows member or diaphragm 28. The diaphragm 28 is operationally connected to one end of a stem valve 30 provided with a plunger 32. The opposite end of the stem 30 is attached to a piston 34 by a nut 36. Nut 36 is also employed to removably secure a diaphragm retainer 38 which engages the interior edge of the diaphragm 28 on the piston 34. The exterior edge of diaphragm 28 is engaged by the air fuel control cover 18.

The piston 34 and diaphragm retainer 38 are preferably formed from steel stampings or the like, and the flexible bellows member or diaphragm 28 should be formed of a material capable of withstanding a pressure differential of at least 150 pounds per square inch. A diaphragm constructed from a fabric coated on both sides has been found to function well for this purpose. An exemplary material for the diaphragm 28 which is capable of withstanding this pressure differential is a 100% dacron fabric coated on both sides with an elastomer, such as 70% fluorosilicone/30% silicone rubber with fillers. However, other, equivalent materials may be employed as well.

A set of dual, oppositely biased springs is provided in the control chamber 22 to bias the piston 34 either toward the air fuel control cover 18 when the intake manifold pressure is below the rated level or away from the cover 18 as the intake manifold pressure increases. The main spring 40 is located within the second chamber 26 and is biased toward the cover 18 to contact piston 34 so that the piston is urged toward the cover 18. A second spring, bias spring 42 is biased away from the cover 18 and, thus, exerts a force opposite that of spring 40 on piston 34. The bias spring 42 is positioned around nut 36 so that one end contacts the diaphragm retainer 38. The opposite end of bias spring 42 engages a bias spring retainer element 44, which is held in place within chamber 24 by the interior end 46 of a threaded adjusting screw 48. The opposite end 50 of adjusting screw 48 extends outwardly from the control chamber 22 through the cover 18, to engage a correspondingly threaded nut 52 located on the exterior of the cover 18. The longitudinal expansion of bias spring 42 can thus be controlled by adjusting the distance which the bias spring adjusting screw 48 extends into the control chamber. The operational significance of this feature of the air fuel control will be explained in more detail hereinbelow.

The air fuel control cover 18 includes an air supply passage 55 formed within a thickened portion 57 of the cover 18 which connects directly to line 16 and, therefore, to the engine intake manifold. Air from the intake manifold may enter chamber 24 of the air fuel control along the path shown by arrows 59.

The air fuel control cover 18 is additionally provided with a central recess 54 defined between the cover thickened portion 57 and a peripheral boss 53 where end 50 of the adjusting screw 48 exits the cover to engage nut 52. Because the air fuel control cover is located immediately adjacent to the engine block, access to the adjusting screw is blocked when the air fuel control is mounted on the engine. Consequently, adjustment of the "no-air" position of the bias spring and, therefore, the piston and associated structures can only be made after the air fuel control is removed from the engine and mounted on a fuel pump test stand. Unauthorized tampering with the air fuel control "no-air" setting while the air fuel control is mounted in place on the engine, therefore, is virtually impossible with the present invention. This is in distinct contrast to prior art air fuel control systems, which are specifically designed to be adjustable on the engine.

Additional tamper proofing may also be provided in the form of a cap 51 which fits securely within recess 54 over the end 50 of adjusting screw 48 and over nut 52 between the air fuel control cover thickened portion 57 and peripheral boss 53 to cover both of these structures completely. A cap 51 having the cross-sectional configuration shown in FIG. 2 is preferred for this purpose. However, other structures which serve the same function may also be employed to prevent the unauthorized adjustment of screw 48 after the air fuel control has been set by the manufacturer and mounted in place on the engine.

As noted hereinabove, the stem valve 30 is provided with a plunger 32 slidably received within a central bore 33 in a barrel 31 mounted in cavity 23 in the interior of the air fuel control housing 20. The profile of the plunger and barrel have been specifically designed as discussed below in connection with FIGS. 3 and 4 to accommodate both the "no-air" and "transition curve" pressure encountered in the fuel supply rail. As a result, the "no-air" adjustment screw typically required on the fuel pump with prior art air fuel controls is not required when the present air fuel control is used.

The plunger 32 includes a central longitudinal channel 35, shown in dashed lines in FIG. 2, which extends from the tip 37 of the plunger toward the second chamber 26. A vent 39 provides fluid communication between channel 35 and the barrel central bore 33 to minimize fuel leakage from the barrel as will be explained in detail hereinbelow.

When the air fuel control stem valve 30 is in the position shown in FIG. 2, the fuel path through the air fuel control is illustrated generally by the arrows 56 which show fuel entering the control through an inlet port 58 and then through an outlet passage 62 to exit outlet port 64. An inlet bypass passage 66 is formed in housing 20 between the inlet port 58 and the cavity 23 which receives the barrel 31. An outlet bypass passage 68 is also formed in housing 20 to direct fuel away from the barrel 34. Inlet passage 66 and outlet passage 68 are aligned with first and second annular grooves 70 and 72, respectively, formed in the exterior surface of the barrel. Grooves 70 and 72 communicate with a barrel fuel inlet passage 74 and a barrel fuel outlet passage 76, respectively.

The barrel 34 is seated within cavity 23 in the air fuel control housing 20 by an annular retaining ring 78 and by a plurality of annular O-ring type seals 80 located at spaced intervals along the exterior surface of the barrel. At least four O-rings of this type are preferred to provide a reliable, substantially leak-proof seal around the barrel 34. A compression spring 82 is further provided within a recess 84 in the housing 20 and biases the barrel toward the retaining ring 78 to hold the barrel and plunger assembly securely in place within the air fuel control housing.

When the plunger 32 is in the position shown in FIG. 2, fuel flow through the barrel 34 from inlet passage 66 to outlet passage 68 is blocked by the plunger. This situation occurs when the pressure of the air in the intake manifold is well below its rated value, or at a "no-air" or zero pressure condition. In this condition, the main spring 40 biases the piston 34 and, hence, the stem valve 30 and plunger 32 toward the air fuel control cover 18 so that a small fuel flow area is created between an undercut edge 60 in the barrel and the plunger profile. This causes the "no-air" fuel to flow into central bore 33 and through fuel passage 76 in the barrel. The bias spring 42 is biased toward the spring retaining element 44 by the piston as shown in FIG. 2 and compressed to a degree which depends upon the location of the retaining element 44. As discussed hereinabove, this location may be adjusted by turning the threaded adjusting screw 48 and is set prior to installation of the air fuel control on the engine to control the extent of the longitudinal movement of the plunger 32 in response to the intake air pressure exerted on the diaphragm 28.

As the pressure of the air in the intake manifold increases, air will enter the air fuel control through the passage 55 and begin to fill the first chamber 24. As the pressure of the air in first chamber 24 increases, pressure will be exerted against the diaphragm 28, the diaphragm retainer 38 and the piston 34, causing the main spring to be compressed and the stem valve 30 to move away from the air fuel control cover 18. The bias spring 42, which was previously compressed, will simultaneously begin to expand and reduce its force on the piston 34, thereby allowing the stem valve and associated structures to move toward recess 84, which moves the plunger 32 to the position shown in FIG. 3. Inlet passage 74 is no longer blocked by the plunger, and an increased amount of fuel may then flow from the barrel cavity 23 into central bore 33 along a path dictated by the plunger profile, and out through the outlet passage 76 to outlet bypass passage 68. The amount of fuel which reaches the cylinders is thus increased when the pressure of the air in the intake manifold increases.

The action of the dual springs 40 and 42 controls the plunger position at zero boost or "no-air" condition with the adjustment to the total available spring length of the main spring 40 and bias spring 42. A boost signal, which is provided to the assembly as the air pressure in the intake manifold increases, moves the plunger 32 by working against the effective area of diaphragm 28 and the combined spring rate of main spring 40 and bias spring 42. Delay in increasing the fuel supply to the cylinders in response to increased manifold air pressure is, as a result, substantially eliminated.

Figure 3:
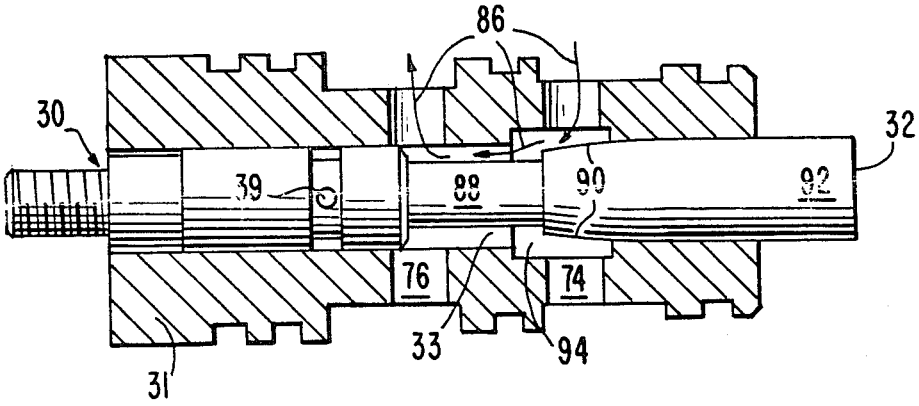
FIG. 3 illustrates a cross-sectional view of a first air fuel control barrel and plunger assembly embodiment.
Figure 4:
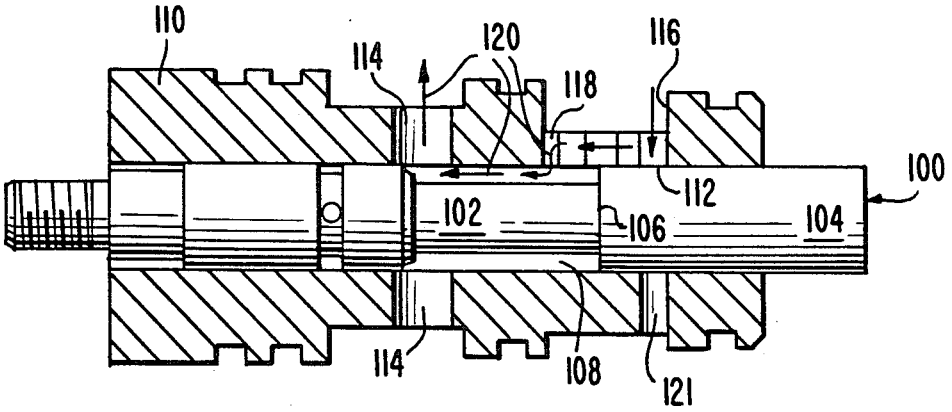
FIG. 4 illustrates a cross-sectional view of a second air fuel control barrel and plunger assembly embodiment.

The profiles of the plunger 32 and the barrel 34 of the present air fuel control will effectively accommodate both the "no-air" and transition curve fuel rail pressures. FIGS. 3 and 4 illustrate cross-sectional views of two embodiments of plunger and barrel profiles which will achieve this objective. The plunger and barrel profile selected will depend in large measure on the "no-air" orifice area of the engine. Both of the plunger and barrel profiles shown in FIGS. 3 and 4 will effectively control fuel metering, however, and both are designed to minimize significantly fuel leakage.

The dimensions of the plunger 32 and barrel 34 of the present invention are critical to the achievement of optimum fuel metering. It has been found that forming the plunger and barrel to provide a class fit therebetween has reduced fuel leakage substantially from that encountered in other air fuel control designs. As a result, structure required to provide fuel drainage is no longer required, and the present air fuel control can be vented, preferably using existing flow passages, to the engine crankcase. The smallest interior diameter of the barrel must not exceed the largest exterior diameter of the plunger by more than 0.000075 to 0.000125 inches to provide the clearance needed for a proper class fit. Tests have indicated that leakage past a barrel and plunger having a clearance within this range is less than about 1.0 cc/hr., which is within the same range as the fuel leakage past a fuel injector and its associated barrel.

The barrel and plunger profile shown in FIG. 3 is one embodiment which provides efficient fuel metering in response to the pressure of the air in the intake manifold as sensed by the diaphragm 28 and related structures. The plunger 32 of FIG. 3 (which is the same plunger profile shown in FIG. 2) does not have a uniform exterior diameter along its full length, but includes a narrow stem section 88, a chamfered profile portion 90, which has a larger average exterior diameter than the stem section, and a stop portion 92 which is larger in diameter than both stem 88 and chamfered portion 90. The barrel profile shown in FIGS. 2 and 3 includes an undercut edge 60 which has a larger diameter than central bore 33 and communicates with both fuel inlet passage 74 and central bore 33. Referring to FIG. 2, it can be seen that when the air fuel control is in a "no-air" condition, the stop portion 92 of plunger 32 allows only a small amount of fuel flow from inlet passage 74 through undercut 60 into barrel central bore 33. As the plunger is moved to the position shown in FIG. 3, however, the chamfered portion 90 of the plunger 32 will gradually open undercut 60 to allow a progressively larger amount of fuel to flow from undercut 60 into bore 33 past the plunger stem portion 88 and through fuel outlet passage 76 as shown by arrows 86 in FIG. 3. Thus, the effective fuel flow volume through the barrel 34 past plunger 32 depends to a large extent upon the size of the fluid flow path created between the plunger and the barrel as undercut 60 is opened to allow fluid to flow into bore 33. Moreover, the profile of the plunger chamfered portion 90 relative to the profile of the barrel bore 33 and undercut 60 will directly affect the metering of fuel through the barrel as the stem valve 30 is moved away from cover 18 in response to manifold air pressure. The plunger profile shown in FIGS. 2 and 3 will provide a gradual release of an increasing quantity of fuel as manifold air pressure increases until the plunger reaches the position shown in FIG. 3, whereupon a maximum amount of fuel will flow through the barrel. As long as the intake air pressure on the diaphragm 28 and piston 34 remains high enough to maintain spring 40 in a compressed condition and to keep the plunger in the position shown in FIG. 3, this maximum amount of fuel will flow into passage 68. However, as soon as the intake air pressure begins to fall, the force exerted against spring 40 decreases so that it is less than that required to keep the spring 40 compressed. The spring 40 will then bias the piston 34 toward the air fuel control cover 18 until it exerts a force on diaphragm 28 equal to that exerted by the pressure of the intake air and the force of the bias spring 42. As the intake air pressure decreases, the piston will be biased an additional distance toward the cover 18, thereby moving the plunger 32 toward the cover so that the plunger will ultimately be located relative to undercut 60 in the "no-air" condition shown in FIG. 2.

FIG. 4 illustrates a second barrel and plunger embodiment which has a different profile from the barrel and plunger embodiment shown in FIG. 3. The plunger 100 of this embodiment includes a narrow stem portion 102 and a wider stop portion 104. However, instead of the chamfered portion 90 of the first embodiment, this plunger embodiment includes a sharp edged, angular shoulder 106. As in the first embodiment, the plunger 100 is disposed within a longitudinal bore 108 in the barrel 110.

The barrel 110 includes fuel inlet ports 112, 118 and 121 and a fuel outlet port 114, which correspond substantially to passages 74 and 76, respectively, in FIG. 3. The configuration of the barrel in the vicinity of inlet port 112 differs from that of barrel 34 in the vicinity of passage 74 of the first barrel and plunger embodiment. The barrel 100 of the second embodiment includes a deep undercut 116 in the area where the barrel would contact the air fuel control fuel supply passage 66 (FIG. 2). In addition, the fuel inlet 112 is connected to a port 118 to supply and meter fuel into the barrel central bore 108 and out fuel outlet bore 114 as shown by arrows 120 in FIG. 4. The inlet 112 has a larger diameter than that of port 118 and a narrow channel (not shown) connects these two passages so that when the barrel 110 is viewed from above in the area of undercut 116, fuel inlet ports 112 and 118 and the connecting channel assume a keyhole-like configuration. The additional fuel inlet port 121 is provided to equalize fuel pressure around the plunger 100.

The position of the plunger 100 shown in FIG. 4 corresponds substantially to the position of the plunger 32 in FIG. 3 and is the position the plunger would occupy when the pressure of the air in the intake manifold increased sufficiently above that associated with the "no-air" plunger position of FIG. 2 to cause the plunger to be moved away from the air fuel cover 18. When the intake air pressure decreases during engine operation, the plunger 100 will be moved toward the air fuel control cover 18, causing port 118 to be blocked by plunger stop portion 104. As increasing air pressure moves the plunger out of contact with port 118, the shoulder 106 gradually opens port 118 to allow increasing amounts of fuel to flow through the barrel central bore 108 to outlet bore 114.

As in the barrel and plunger embodiment shown in FIGS. 2 and 3, the plunger 100 and barrel 110 of FIG. 4 are formed to fit together in a class fit, wherein the clearance between the plunger exterior diameter and the barrel interior diameter must not exceed 0.000075 to 0.000125 inches. As discussed hereinabove, leakage of fuel from the barrel is thereby substantially minimized.

The present barrel and plunger assembly is designed to minimize fuel leakage around the plunger and barrel. This is achieved by controlling the pressure differential between the second chamber 26 and the barrel central bore 33 at the tip 37 of the plunger. The provision of plunger central channel 35, the vent 39, and a conduit 122 which connects to the fuel pump housing allows the high pressure of the fuel in central bore 33 to be reduced by the time the fuel reaches the area of the vent 39 and to be reduced further by the time the fuel reaches the second chamber 26. Fuel leakage into this cavity is, therefore, substantially eliminated as excess fuel is vented through vent 39 to be returned to the fuel pump through conduit 122. Unlike prior art air fuel control devices, the present air fuel control maintains second chamber 26 in a near fuel-free condition by controlling the pressure differential between the vent 39 and the second chamber 26.

Figure 5:
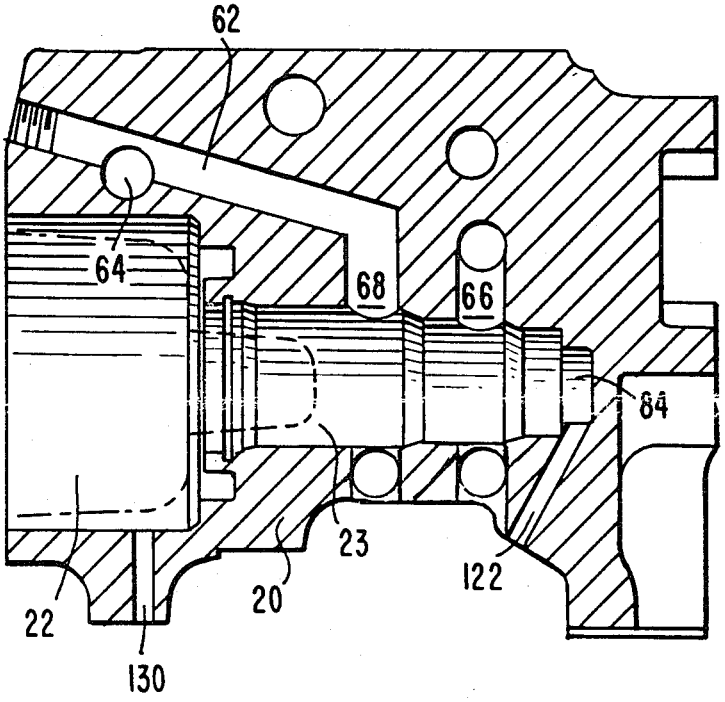
FIG. 5 is a front cross-sectional view of an internal combustion engine fuel pump taken along line 5—5 of FIG. 1 illustrating the location of the air fuel control relative to the fuel pump.

Although the provision of a barrel and plunger assembly with a class fit as described herein significantly minimizes fuel leakage, a drain is required to insure that any excess fuel which may be present is removed. The present air fuel control, however, does not require the extensive external drain system of prior art air fuel controls. The very minimal amount of fuel which might leak past the plunger is, instead, vented through internal passages in the fuel pump to the engine crankcase. FIG. 5 illustrates a cross-sectional view of the air fuel control housing 20, as it would appear without the air fuel control mechanism, to illustrate one possible drain line for excess fuel. As can be clearly seen from FIG. 5, control chamber 22 is fluidically connected with barrel cavity 23. Any fuel which might leak past the plunger, particularly in the vicinity of the terminal end of the barrel adjacent to the control chamber 22, and specifically in chamber 26, would tend to collect in second chamber 26. Consequently, a drain line 130 may be provided to serve as a fluid passage for excess fuel from the air fuel control to other conduits in the fuel pump (not shown) which drain to the engine crankcase. Such a drain conduit may be located in the fuel pump cover (not shown), for example.

As a comparison of the air fuel control housing (FIG. 5) and the air fuel control mechanism positioned in that housing (FIG. 2) illustrates, the present invention includes a plurality of separate components which are assembled and inserted into this air fuel control housing in the fuel pump. Therefore, the present invention is ideally suited for retrofitting existing fuel pumps which include a similar housing or bore in the fuel pump for an air fuel control. Appropriate shims, retaining rings, seals and the like could be employed where necessary for proper installation of the present air fuel control. Moreover, since the exterior dimensions of the barrel portion of the present air fuel control correspond closely to those of many existing air fuel control devices, it is possible to substitute one of the present barrel and plunger assemblies to provide substantially leak-free, efficient fuel metering in response to intake manifold pressure.

Industrial Applicability

The air fuel control of the present invention will find its primary application in an internal combustion engine of the compression ignition type wherein fuel is supplied to the engine in response to the pressure of the air in the intake manifold. It will be particularly useful for carefully and precisely controlling the flow of fuel to the engine cylinders in response to engine operating conditions. The present air fuel control may be effectively employed both to provide a metered flow of fuel from the fuel pump in response to increasing manifold air pressure and to reduce gradually the flow of fuel from the fuel pump in response to decreasing manifold air pressure. Further, the air fuel control of the present invention is ideally suited both for original installation in new engines and for retrofitting existing engines.

We claim:

1. A fuel supply system for an internal combustion engine which is operationally controlled by the pressure of fuel supplied to the engine from a fuel source and which has an intake manifold for supplying air to the engine, comprising (a) air pressure responsive means for modulating mechanically the flow of fuel into the engine in response to the pressure of air within the intake manifold, said air pressure responsive means including:

(1) first and second chambers, wherein said first chamber includes means for fluid connection with the engine air supply and said second chamber is sealed from fluid connection with said fuel supply system, and (2) pressure responsive actuating means dividing said first and second chambers for transforming changes in intake manifold pressure into mechanical movement for operating said air pressure responsive means, said pressure responsive actuating means comprising a diaphragm, (b) fuel metering means including, a valve stem that is directly connected to said diaphragm so as to be movable in response to air pressure changes within said first chamber, said fuel metering means for controlling the flow of fuel from said fuel supply system directly in response to changes in intake manifold pressure between a substantially blocked position and a fully open position, and (c) a pair of oppositely biased spring means located on opposite sides of said diaphragm, wherein a first spring means is located in said first chamber and is biased to move said diaphragm and said fuel metering means by way of said valve stem in a first direction and a second spring means is located in said second chamber and is biased to move said diaphragm and said fuel metering means by way of said valve stem in a second direction opposite to said first direction, said first and second spring means maintain said fuel metering means in said substantially blocked position when said intake manifold pressure in said first chamber is zero, said first spring means moves said fuel metering means in said first direction toward said fully open position as the pressure in said first chamber is increased, and said second spring means moves said fuel metering means in said second direction back toward said substantially blocked position when pressure is decreased in said first chamber to zero, whereby said pair of oppositely biased spring means cause quick and precise movement of said fuel metering means with intake pressure changes in said first chamber to align said fuel metering means in a position which permits the flow of fuel at a rate that is directly related to the intake manifold pressure, thereby substantially eliminating any delay in increasing fuel supply to the engine.

2. A fuel supply system as described in claim 1, wherein said fuel metering means includes barrel means for providing a connection between said fuel source and said fuel supply system and plunger means fitted within said barrel means for controlling the flow of fuel from said fuel supply system.

3. A fuel supply system as described in claim 2, wherein the clearance between said barrel means and said plunger means does not exceed 0.000075 to 0.000125 inches.

4. A fuel supply system as described in claim 2, wherein said barrel means comprises a substantially cylindrical barrel having a hollow interior located along a long axis substantially perpendicular to said diaphragm and includes a fuel supply inlet passage and a fuel supply outlet passage for directing fuel respectively into and out of the interior of the barrel.

5. A fuel supply system as described in claim 4, wherein said plunger means is connected to said valve stem for connection to said diaphragm, and includes stop means for blocking fuel flow through said fuel supply inlet passage and fuel control means positioned between said valve stem and said stop means for controllably admitting fuel into said barrel interior.

6. A fuel supply system as described in claim 5, wherein said pressure responsive actuating means moves said plunger along the longitudinal axis of said barrel in a direction which is directly dependent upon the pressure of the air in the intake manifold.

7. A fuel supply system as described in claim 6, wherein when said intake air pressure is zero, said pressure responsive actuating means moves said plunger to locate said stop means in a position to block substantially fuel flow through said fuel supply inlet passage and when said intake air pressure is at its maximum rated level, said pressure responsive actuating means moves said plunger to locate said fuel control means in a position to allow a maximum amount of fuel flow through said fuel supply inlet passage.

8. A fuel supply system as described in claim 7, wherein said barrel interior includes cavity extension means having a larger diameter than said barrel interior for receiving fuel from said fuel supply inlet passage, said plunger stop means has a larger diameter than said stem means, and said plunger fuel control means includes chamfer means for providing a gradual change in plunger diameter between said valve and said stop means.

9. A fuel supply system as described in claim 7, wherein said barrel includes port means for interaction with said fuel metering means to control the amount of fuel flow through said barrel, said plunger stop means has a larger diameter than said valve stem and said plunger fuel control means includes angular shoulder means having a diameter substantially equal to the diameter of said stop means for controlling fuel flow from said port means and said fuel supply inlet passage.

10. A fuel supply system as described in claim 1, further including fuel drainage means for directing excess fuel away from said fuel supply system to the engine crankcase.

11. A fuel supply system as described in claim 10, wherein said fuel drainage means is located completely internally to the engine.

12. A fuel supply system as described in claim 5, wherein the distance between said plunger and the interior of said barrel is in the range of about 0.000075 to 0.000125 inches.

13. A plunger and barrel assembly for a fuel supply system for an internal combustion engine which is operationally controlled by the pressure of fuel supplied to the engine from a fuel source and which has an intake manifold for supplying air to the engine, air pressure responsive means for modulating mechanically the flow of fuel into the engine in response to the pressure of air within the intake manifold, and housing means for receiving said fuel supply system, said plunger and barrel assembly including longitudinal barrel means adapted to be engaged by said housing means to provide a fluid connection between said fuel source and said engine, and plunger means connected directly to said pressure responsive means slidably class fitted within a central bore in said barrel means to be coaxial therewith for selectively opening and closing said fluid connection manifold, wherein said plunger means includes pressure regulating means for providing a pressure connection between said central bore in said barrel means, at a point between said fluid connection and said connection of said plunger means to said pressure responsive means, and said housing, thereby substantially eliminating fuel leakage from said assembly.

14. A plunger and barrel assembly as described in claim 13, wherein said pressure regulating means includes conduit means internal to said plunger means for directing excess fuel therethrough and vent means for providing fluid communication between said conduit means and said barrel means.

15. A plunger and barrel assembly as described in claim 13, wherein said barrel means includes an interior cavity extension which provides fluid communication between said fuel supply and the engine and said plunger means includes chamfer means for gradually metering the flow of fuel from the fuel supply through the barrel interior cavity extension to the engine and stop means for blocking the flow of fuel from the fuel supply through the barrel interior cavity extension to the engine.

16. A plunger and barrel assembly as described in claim 15, wherein the chamfer means has a gradually increasing diameter along the longitudinal axis of the plunger means, and the stop means has a substantially constant diameter approximately equal to the largest diameter of said chamfer means along the remaining longitudinal axis of said plunger.

17. A plunger and barrel assembly as described in claim 16, wherein the difference between the diameter of the stop means and the diameter of the barrel means central bore is about 0.000075 to 0.000125 inches.

18. A plunger and barrel assembly as described in claim 13, wherein said barrel means includes port means for providing fluid communication between said fluid supply and the engine, and said plunger means includes annular shoulder means for directing fuel flow through said port means into the barrel central bore and stop means for blocking the flow of fuel through said port into the barrel central cavity.

19. A plunger and barrel assembly as described in claim 18, wherein the cross-sectional diameter of said annular shoulder means is substantially equal to the cross-sectional diameter of said stop means.

20. A plunger and barrel assembly as described in claim 19, wherein the difference between the diameter of the stop means and the diameter of the barrel means central bore is about 0.000075 to 0.000125 inches.

21. An air fuel control for an internal combustion engine which is operationally controlled by the pressure of fuel supplied to the engine from a fuel source, which has an intake manifold for supplying air to the engine and which includes pressure responsive means connected to the intake manifold for modulating mechanically the flow of fuel into the engine on response to the pressure of the air within the intake manifold, said air pressure responsive means comprising (a) a first chamber fluidically connected to said intake manifold and a second chamber separated from said first chamber by a flexible bellows member secured to a piston;

(b) a pair of oppositely biased spring means located on opposite sides of said piston for transforming changes in intake manifold pressure into mechanical movement, wherein one of said spring means is located in said first chamber and is biased to move said piston in a first direction and the other of said spring means is located in said second chamber and is biased to move said piston on a second direction opposite to said first chamber direction; and (c) fuel metering means having a valve stem attached directly to said piston for movement with said piston between a first, fuel flow position and a second, fuel blocked position, wherein as the pressure of intake air in said first chamber against said bellows member increases, said one spring means biases said piston in said first direction to move said fuel metering means to said first position, thereby allowing fuel to flow through said air fuel control as the pressure of intake air in said first chamber against said bellows member decreases, said direction to move said fuel metering means to said second position, thereby substantially blocking fuel from flowing through said air fuel control, wherein said one spring means includes an adjustable spring retaining means within said first chamber for controlling the extent of the longitudinal compression and expansion of said one spring means within said first chamber in response to increasing air pressure, thereby controlling the amount of air pressure required to bias said piston in said first direction.

22. An air fuel control as described in claim 21, wherein said spring retaining means includes adjustment means exterior to said first chamber for engaging said spring retaining means at the desired air pressure setting.

23. An air fuel control as described in claim 22, wherein said air fuel control includes cover means secured thereto for defining the extent of said first chamber and securing said bellows member to said air fuel control.

24. An air fuel control as described in claim 23, wherein said cover means includes a recessed central portion, said adjustment means is located in said recessed central portion, and said recessed central portion is positioned immediately adjacent to the engine, thereby blocking access to said adjustment means, when said air fuel control is mounted on the engine.

25. The air fuel control as described in claim 24, wherein cap means for covering said adjustment means is fitted within said recessed central portion.

* * * * *